United States Patent [19]

Heller et al.

[11] Patent Number: 4,532,864

[45] Date of Patent: Aug. 6, 1985

[54] PRINTING MACHINE WEB TURNING BAR ADJUSTMENT MECHANISM

[75] Inventors: Albert Heller, Pestenacker; Hubert Birkmair, Friedberg; Hermann Grauberger, Augsburg, all of Fed. Rep. of Germany

[73] Assignee: M.A.N.-Roland Druckmaschinen Aktiengesellschaft, Offenbach am Main, Fed. Rep. of Germany

[21] Appl. No.: 471,803

[22] Filed: Mar. 3, 1983

[30] Foreign Application Priority Data

Apr. 24, 1982 [DE] Fed. Rep. of Germany ... 8211907[U]

[51] Int. Cl.[3] ..... B41F 13/06

[52] U.S. Cl. ..... 101/219; 226/197; 270/52

[58] Field of Search ..... 226/197, 199; 101/212, 101/219; 270/52; 400/707.5, 556.1

[56] References Cited

U.S. PATENT DOCUMENTS

| | | | |
|---|---|---|---|
| 836,749 | 11/1906 | Goss | 270/52 |
| 1,021,386 | 3/1912 | Uhlig | 400/556.1 |
| 1,610,671 | 12/1926 | Funk | 226/197 |
| 2,133,804 | 10/1938 | Bolongaro | 400/707.5 |
| 2,495,909 | 1/1950 | Ross | 270/52 |
| 2,626,036 | 1/1953 | Sternfeld | 400/707.5 |
| 2,760,773 | 8/1956 | Brodie | 226/197 |
| 3,339,817 | 9/1967 | French | 226/197 |
| 3,399,884 | 9/1968 | Bahrani | 226/197 |
| 3,734,489 | 5/1973 | Treff | 226/197 |
| 3,809,303 | 5/1974 | Brunner | 226/197 |
| 3,940,043 | 2/1976 | Staples | 226/199 |
| 4,239,141 | 12/1980 | Frye | 226/197 |
| 4,437,400 | 3/1984 | Ellis | 101/18 |

*Primary Examiner*—William Pieprz

*Attorney, Agent, or Firm*—Frishauf, Holtz, Goodman & Woodward

[57] ABSTRACT

To indicate externally of a printing machine the position of a turning bar, the turning bar (15) drive spindle (1) is coupled to a numerical indicator (11) by a worm gearing (8, 9). The numerical indicator, having a plurality of number wheels, is capable of indicating the position of the turning bar (15) on a traverse rod (14). Preferably, a stop wheel (6) having ball-loaded detents at its circumference provides for predetermined angular positions of fractional revolutions of the spindle.

3 Claims, 2 Drawing Figures

Figures 1, 2:
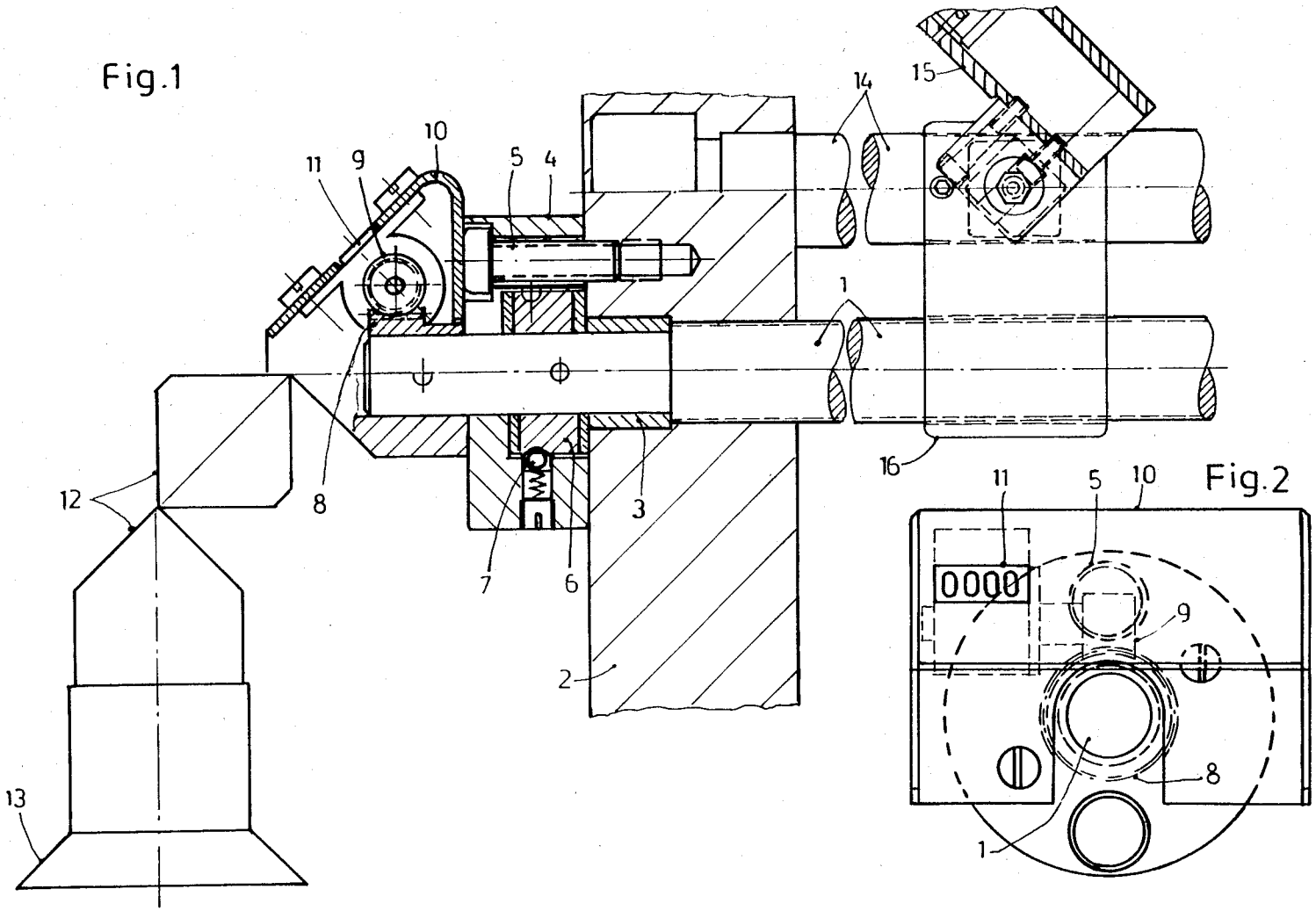

1
2
3
4
5
6
7
8
9
10
11
12
13
14
15
16

PRINTING MACHINE WEB TURNING BAR ADJUSTMENT MECHANISM

The present invention relates to printing machines, and more particularly to an adjustment mechanism for a turning bar to properly orient or turn a web of material on which printing is to be effected, or has been effected.

BACKGROUND

Printing machines, particularly rotary printing machines of the web-fed type, require paper feed in predetermined directions and, frequently, it is necessary to turn the paper web. Turning is effected by providing a turning bar over which the paper web is guided, for example to deflect the paper from a horizontal to a vertical path, or the like.

When changing paper or changing production, it is frequently necessary to readjust the position of the turning bars. Turning bars are customarily located on a cross bar or cross rod, and adjustable, therealong, by rotating a hand wheel which drives a spindle, coupled to the turning bar, to then place the turning bar in the desired position. Locating the turning bar requires some skill and adjustment "by feel" until the required positioned of the turning bar has been found, and by checking the resulting printed or supplied material. For example, the position of the turning bar has to be adjusted, in small steps, until a certain folding position or folding operation is properly aligned. Such adjustment "by feel" requires skill and may still result in substantial production of scrap printed material.

THE INVENTION

It is an object to so construct a turning bar that the position of the turning bar can be accurately controlled so that it can be placed or readjusted, as desired, without complex adjustment steps, and which permits the adjustment to be carried out by personnel, even if not highly skilled Briefly, in accordance with the invention, the turning bar adjustment mechanism is extended beyond that required for the drive and coupled to an indicator which provides a position indication of the turning bar, with respect to a reference. Thus, the position of the turning bar can be visually indicated—although the turning bar may be hidden by the printed web itself—and repositioned to the indicated value at any time.

In accordance with a preferred feature of the invention, the spindle which drives the turning bar and placed it in the appropriate position is coupled to a counter, for example to a digital mechanical counter, which counts the revolutions or fractions thereof of the spindle, and provides a read-out of a number which may represent a code or a specific position of the turning bar. Upon change of paper, it is only necessary, then, to look up the required position of the changed paper, and move the spindle until the indicator shows the desired code or position number.

DRAWINGS

FIG. 1 is a schematic side view of a turning bar and its positioning arrangement, with the indicator shown schematically; and FIG. 2 is a front view of the indicator, and showing only those elements of the mechanism coupling it to the turning bar necessary for an understanding of the invention.

A drive spindle 1 is retained in side walls 2 of the housing. A similar side wall is located at the right side of the printing machine, and not shown for simplicity. The spindle 1, which is threaded as is customary, is journalled for rotation in a bushing 3, fitted in the side wall 2. A similar bearing is located at the right side in the side wall, which is not shown in the drawing. The bushing may, for example, be press-fitted in the side wall.

In accordance with a feature of the present invention, the spindle 1 is elongated or extended beyond the bushing 3 to extend from the side wall 2 and accomodate not only a spindle drive arrangement 12, 13—to be described below—but, additionally, the indicator mechanism of the present invention.

A flange 4 is secured to the side wall 2 by a screw 5. The spindle 1 has a positioning wheel 6 attached thereto which is formed at its circumference with periodically spaced depressions, engaged by a ball 7 which is spring-loaded, to snap into the respective depressions in the wheel 6, so that the angular position of the spindle 1 can be accurately predetermined. Additionally, and in accordance with a feature of the invention, the drive spindle 1 has a worm 8 connected thereto which is engaged by a worm wheel 9, the worm/wheel combination 8/9 forming a reduction gearing. The worm wheel 9 is coupled to a counter 10 which has an indicator 11 coupled thereto.

The spindle 1 is rotated by any well known means, for example, as shown, by a hand wheel 13 which is coupled via a universal joint, shown schematically at 12, to the spindle 1 for rotation of the spindle upon rotation of the hand wheel 13. As seen in FIG. 1, the coupling of the hand wheel to the spindle 1 is independent of the worm/wheel combinations 8/9. Any other suitable and customary ways of rotating the spindle 1 may be used and, for example, a drive motor may be coupled thereto.

The number of rotations of the spindle or, upon suitable subdivision, the angular position of the spindle in addition to the number of rotations thereof can be precisely indicated by the indicator 11 of counter 10.

The turning rod 15 is retained, in suitable and well known manner, on a bracket 16 which is slidable on a cross bar, or slide or cross rod 14. Bracket 16 carries an internal thread in engagement with the thread on the spindle 1, for translatory movement of the turning bar 15 upon rotation of the spindle 1.

Operation: If a predetermined position of the turning rod 15 on the cross bar 14 is desired, the wheel 13 is rotated until the indicator 11 shows the appropriate number in accordance with the desired position. The turning rod 15 then has been moved by the spindle 1 into the position which was selected.

The indicator and counter 10, 11 has an indicator element 11 with a plurality of indicator fields, for example one for each number. The numbers are located on number wheels, coupled to the worm 9, and rotated thereby, in accordance with well known rotary position indicator technology.

Various changes and modifications may be made within the scope of the inventive concept.

We claim:

1. Printing machine turning bar adjustment mechanism for a printing machine having a side wall (2) comprising a side wall (2);

a turning bar (15) located inwardly of one side of the side wall;

a longitudinally extending cross bar (14), the turning bar being mounted on the cross bar for positioning the turning bar in adjustable positions along the length thereof, and including a spindle (1) extending parallel to the cross bar (14);

coupling means (16) slidable on the cross bar (14) and engageable by the spindle to move the turning bar longitudinally along the cross bar upon rotation of the spindle;

an extending portion formed on the spindle, projecting from the spindle at the side of the side wall remote from the turning bar;

a holding flange (4) secured to the side wall and rotatably retaining the extending portion of the spindle;

a positioning wheel (6) located within the holding flange (4) coupled to the extending portion of the spindle (1) and having spring-loaded ball and detent means (7) for engaging the positioning wheel and locating the positioning wheel, and hence the spindle (1), at predetermined angular positions;

a worm (8) formed on the spindle (1);

a gear (9) in engagement with the worm and forming, in combination with the worm, a reduction gearing;

a numerical revolution indicator (10, 11) coupled to the gear (9), the numerical revolution indicator including a plurality of number wheels;

and a drive wheel (13) coupled to the spindle, independently of the worm (8) and the gear.

2. Mechanism according to claim 1, wherein the spring-loaded ball-and-detent means includes a spring-loaded ball located in the holding flange, and detents formed on the positioning wheel (6).

3. Mechanism according to claim 1, wherein the drive wheel (13) comprises a hand wheel.

* * * * *